US008042700B1

(12) United States Patent
Smalley

(10) Patent No.: US 8,042,700 B1
(45) Date of Patent: Oct. 25, 2011

(54) END CAP SHELF SYSTEM

(76) Inventor: Daniel J. Smalley, Cumberland, RI (US)

( * ) Notice: Subject to any disclaimer, the term of this patent is extended or adjusted under 35 U.S.C. 154(b) by 341 days.

(21) Appl. No.: 12/317,611

(22) Filed: Dec. 29, 2008

(51) Int. Cl.
*A47F 5/08* (2006.01)

(52) U.S. Cl. ..... 211/90.01; 211/88.01

(58) Field of Classification Search ..... 211/57.1, 211/59.1, 193, 88.01, 90.04, 90.02, 90.01, 211/94.01, 87.01; 108/108, 152, 147.17; 248/220.31, 220.41
See application file for complete search history.

(56) References Cited

U.S. PATENT DOCUMENTS

| | | | | | |
|---|---|---|---|---|---|
| 3,407,939 | A | * | 10/1968 | Villar-Kelly | 211/90.01 |
| 3,858,725 | A | * | 1/1975 | Pietrack et al. | 211/85.7 |
| 4,008,808 | A | * | 2/1977 | Ramsay | 211/65 |
| 4,441,433 | A | * | 4/1984 | Caldwell | 108/152 |
| 4,708,310 | A | * | 11/1987 | Smith | 248/220.1 |
| 4,720,069 | A | * | 1/1988 | Bessinger | 248/250 |
| 4,817,900 | A | * | 4/1989 | Whittington et al. | 248/223.41 |
| 4,828,120 | A | * | 5/1989 | Beil et al. | 211/88.01 |
| 4,843,977 | A | * | 7/1989 | Bridges | 108/152 |
| 4,872,567 | A | * | 10/1989 | Bustos | 211/59.2 |
| 5,197,703 | A | * | 3/1993 | Pratolongo | 248/225.11 |
| 5,456,435 | A | * | 10/1995 | Sweeney | 248/250 |
| 5,711,435 | A | * | 1/1998 | Morison et al. | 211/90.01 |
| 5,769,520 | A | * | 6/1998 | Jun et al. | 312/408 |
| 5,794,902 | A | * | 8/1998 | Henry et al. | 248/250 |
| 5,799,803 | A | * | 9/1998 | Muller | 211/90.01 |
| 5,960,965 | A | * | 10/1999 | Saunders | 211/35 |
| 6,105,794 | A | * | 8/2000 | Bauer | 211/94.01 |
| 6,158,599 | A | * | 12/2000 | Lazarus | 211/90.01 |
| 6,164,610 | A | * | 12/2000 | Santiago | 248/235 |
| 6,220,461 | B1 | * | 4/2001 | Dickinson | 211/90.01 |
| 6,402,106 | B1 | * | 6/2002 | Padiak | 248/221.11 |
| 6,615,745 | B2 | * | 9/2003 | Cinkaj | 108/152 |
| 7,255,236 | B1 | * | 8/2007 | Sauder et al. | 211/90.01 |
| 7,270,309 | B2 | * | 9/2007 | Burns et al. | 248/317 |
| 7,743,933 | B2 | * | 6/2010 | Martin et al. | 211/189 |
| 2006/0213848 | A1 | * | 9/2006 | Kim et al. | 211/90.01 |
| 2007/0012637 | A1 | * | 1/2007 | Yu et al. | 211/96 |

* cited by examiner

*Primary Examiner* — Jennifer E. Novosad
(74) *Attorney, Agent, or Firm* — Robert J Doherty

(57) ABSTRACT

A shelf system adapted to be attached and removed from end cap supporting walls in limited vertical headspace situations by providing a separate thin walled connector strip which is releasably attached to the rear wall of the shelf and on which the end cap wall connection means are positioned as opposed to the shelf rear wall itself.

7 Claims, 14 Drawing Sheets

END CAP SHELF SYSTEM

BACKGROUND OF THE INVENTION

This invention is directed to store end cap shelving and more particularly to a system for quickly and easily rearranging the shelf position and relative spacing between adjacent shelves on such end caps. Historically, the end cap display shelves in retail stores such as drugstores, big box retailers, discount outlets and the like have open trays or shelves on which merchandise is supported and displayed for sale. The shelves are vertically spaced from each other and project perpendicularly from the end cap walls that are, in turn, provided with openings to receive supporting or hanging projections extending to from the rear of the shelves. Since end caps are normally utilized for sale, promotional and/or seasonal merchandise or goods and oftentimes that merchandise takes a variety of forms and sizes, it is desirable that the vertical position of the individual shelves or trays be easily and effortlessly moved up and down to accommodate the variously sized merchandise placed thereon.

For instance, the trays could support or contain small individual packages such as candy, cosmetics, office supplies and the like or could contain moderately large stuffed animals, electronics, kitchen electrics dependent on the store manager's marketing strategy and the season of the year. Naturally, the tray or shelf displaying the stuffed animals or other large items requires a larger to vertical spacing between itself and the tray immediately above than would a similarly placed tray having smaller items displayed thereon. Thus when the particular special or seasonal sale is over and alternate merchandise of differing sizes requiring dissimilar spacing requirements vis-à-vis the other trays above and below, the originally positioned trays must be removed from the end cap support wall and this could necessitate the removal of several trays positioned thereabove due to the space required to upwardly tilt the front end of the tray to disengage the connecting means from the receiving openings provided in the end cap support wall. This can result in a time consuming rearrangement of several upper shelves as well as the possibility of unnecessarily removing the goods on such adjacent shelves when those goods are to remain on display.

Accordingly, the present invention presents a shelf construction and system for enabling a single shelf to be removed from the shelf support and rearranged thereon in an altered vertical position within a much smaller vertical space than with prior art systems and thus eliminating the need to temporarily remove the shelf or shelves above that single shelf. This is preferably accomplished by modifying the rear portion of the presently utilized shelves in a simple and cost effective manner.

These and other objects of the present invention are accomplished by providing a releasable thin wall connector strip to the rear upstanding shelf wall and providing the attachment means for engaging the receiving openings in the end cap support wall. The strip, in essence, replaces the connecting function of the rear wall of the shelf. Since the strip is of very limited longitudinal extent, the strip itself can be upwardly tilted within a limited headspace to enable the connecting means provided thereon to slip out of the end cap wall openings and is then be reinserted into similar openings spaced above or below the original position. The shelf itself can then be reattached to the strip within a headspace only slightly greater than the vertical height of the shelf itself. This enables shelf rearrangement in limited spacing situations that would be impossible with currently used systems and generally avoids displacing the adjacent shelves above the selected shelf when those other shelves do not otherwise require repositioning.

These and other objects of the present invention are accomplished by an end cap shelf system for mounting display shelves upon an end cap wall having openings adapted to receive shelf supporting means comprising a shelf having a flat bottom wall, a rear wall and front and side walls defining an open top display space adapted to receive merchandise for sale, said rear wall being laterally disposed and having a generally flat outer surface, a separate thin walled connector strip having generally planar opposed inner and outer faces to and connection means cooperatively provided on the outer face of said shelf rear wall and the inner face of said connector strip for releasably engaging said connector strip to said shelf rear wall when said connection means are vertically and laterally disposed with each other, and releasable locking means for holding said connector strip and said rear shelf wall in assembled engaged position, said strip outer face including said shelf supporting means.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 11 is a front elevational view of the connector strip shown in

FIG. 9;

DESCRIPTION OF THE INVENTION

Figure 1:
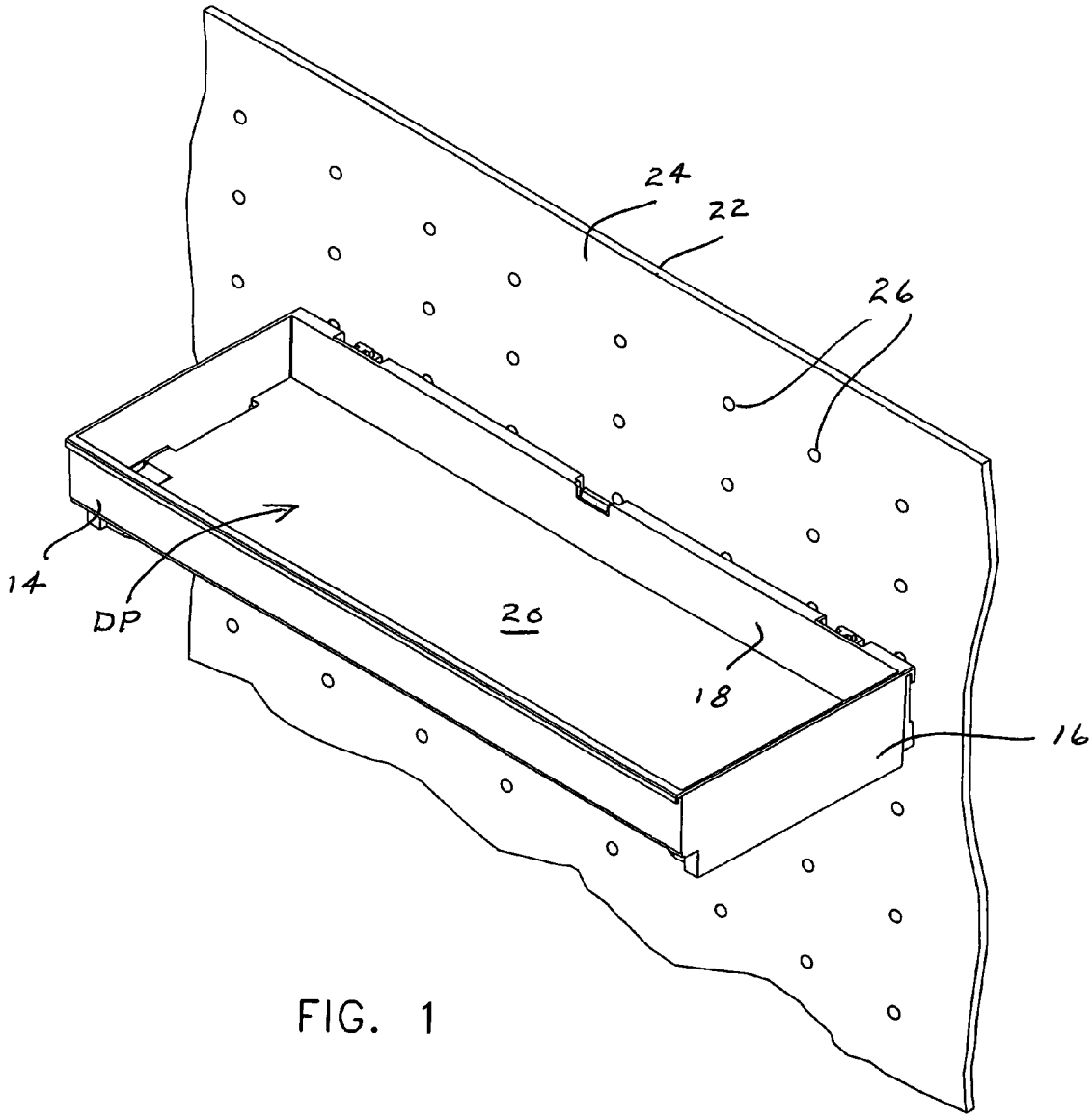
FIG. 1 is a front perspective view of a shelf assembly depicting one form of the invention mounted upon an end cap supporting wall provided with peg receiving openings.
Figure 1A:
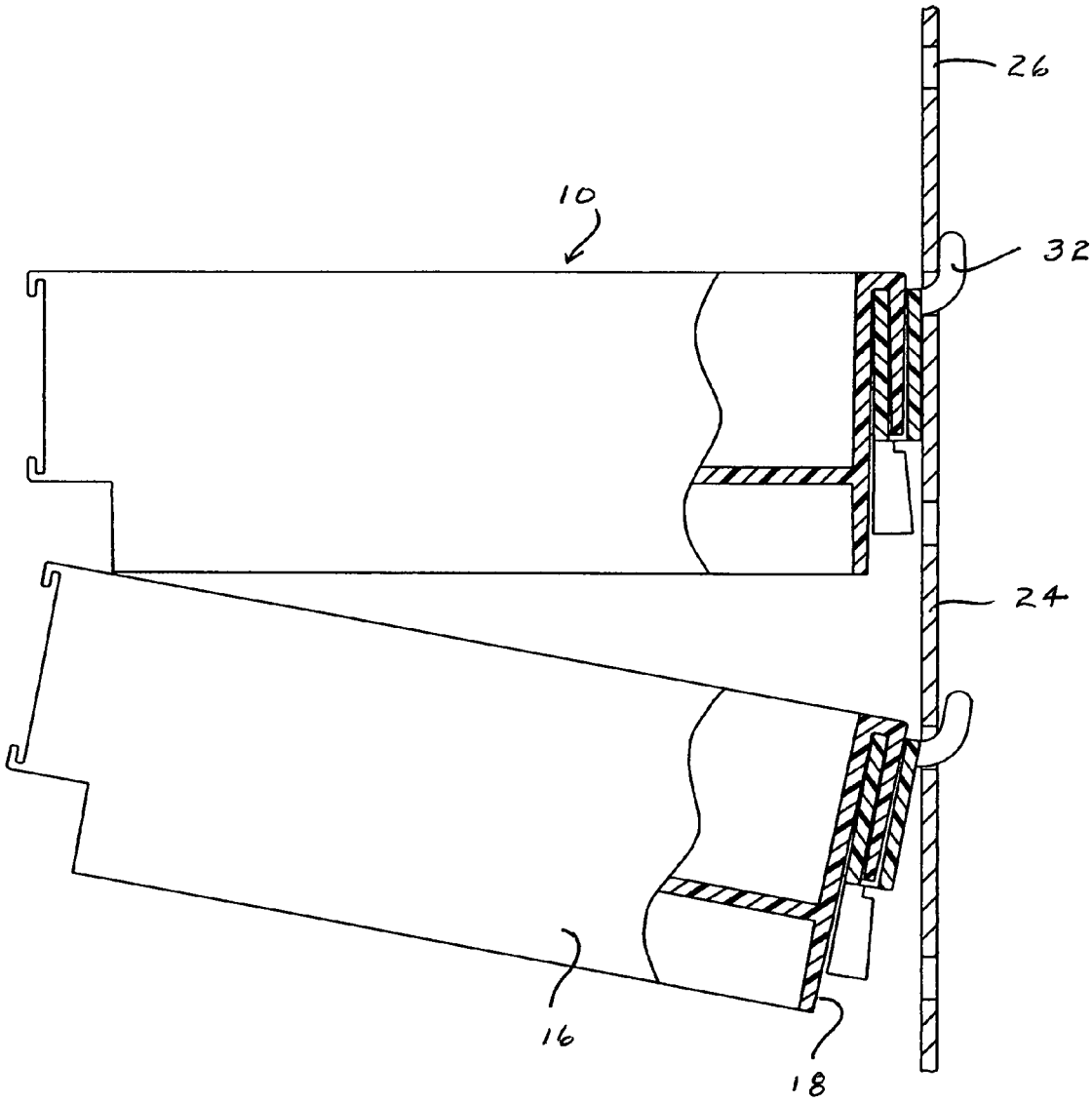
FIG. 1A is a side sectional view of two closely spaced shelves mounted on a pegboard and illustrating the difficulty of attempting to remove the lower shelf without the use of the present invention.
Figure 2:
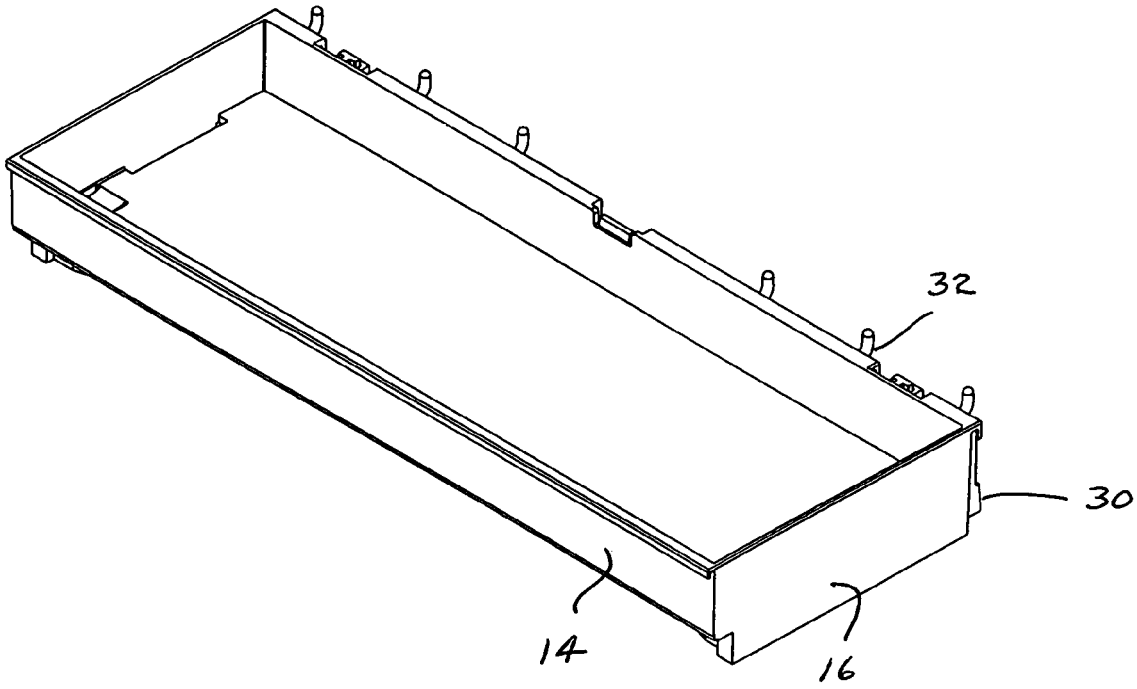
FIG. 2 is a perspective view of the shelf assembly shown in FIG. 1.
Figure 3:
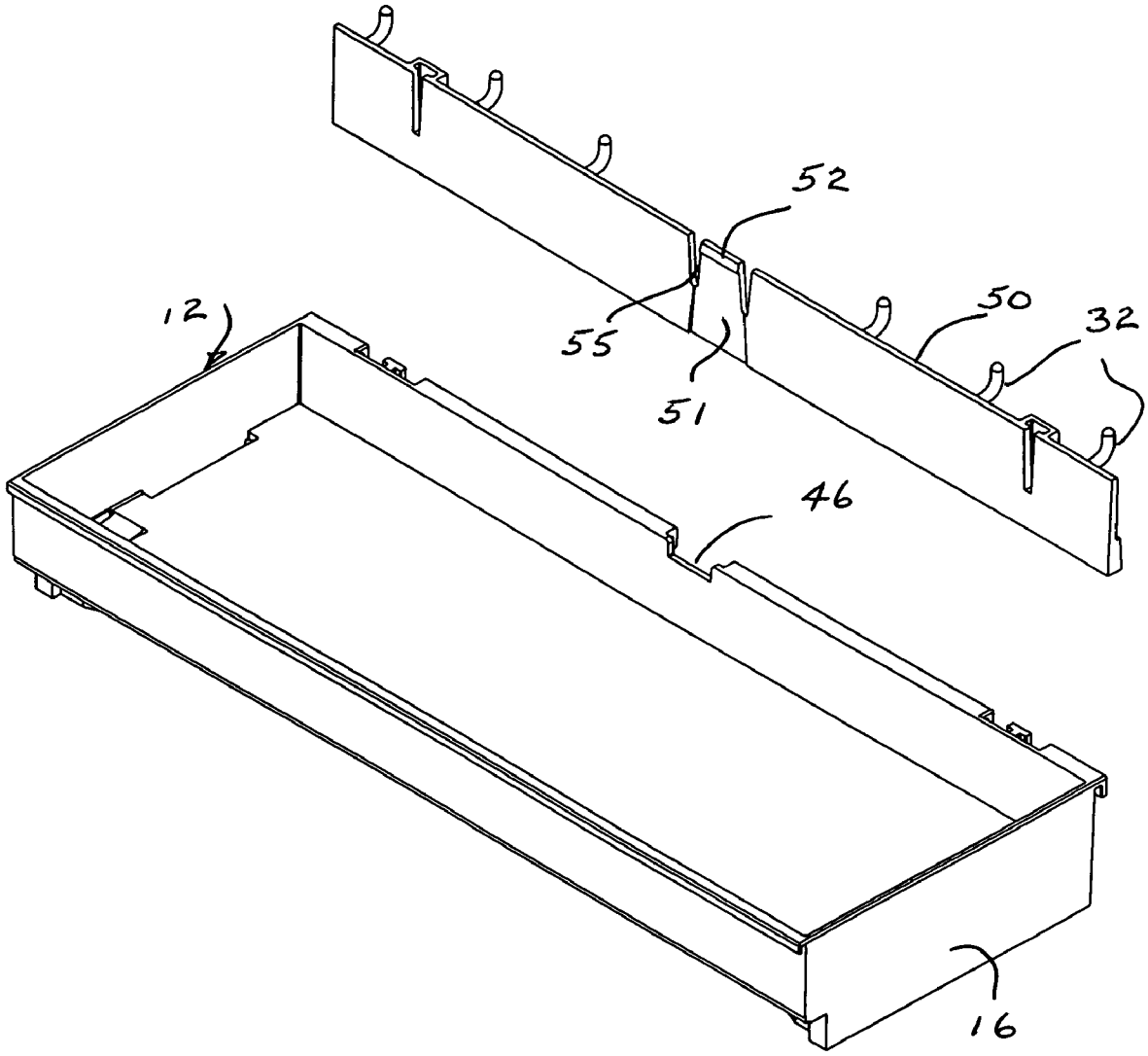
FIG. 3 is a perspective view of the shelf shown in FIG. 1 with the connector strip separated therefrom.
Figure 4:
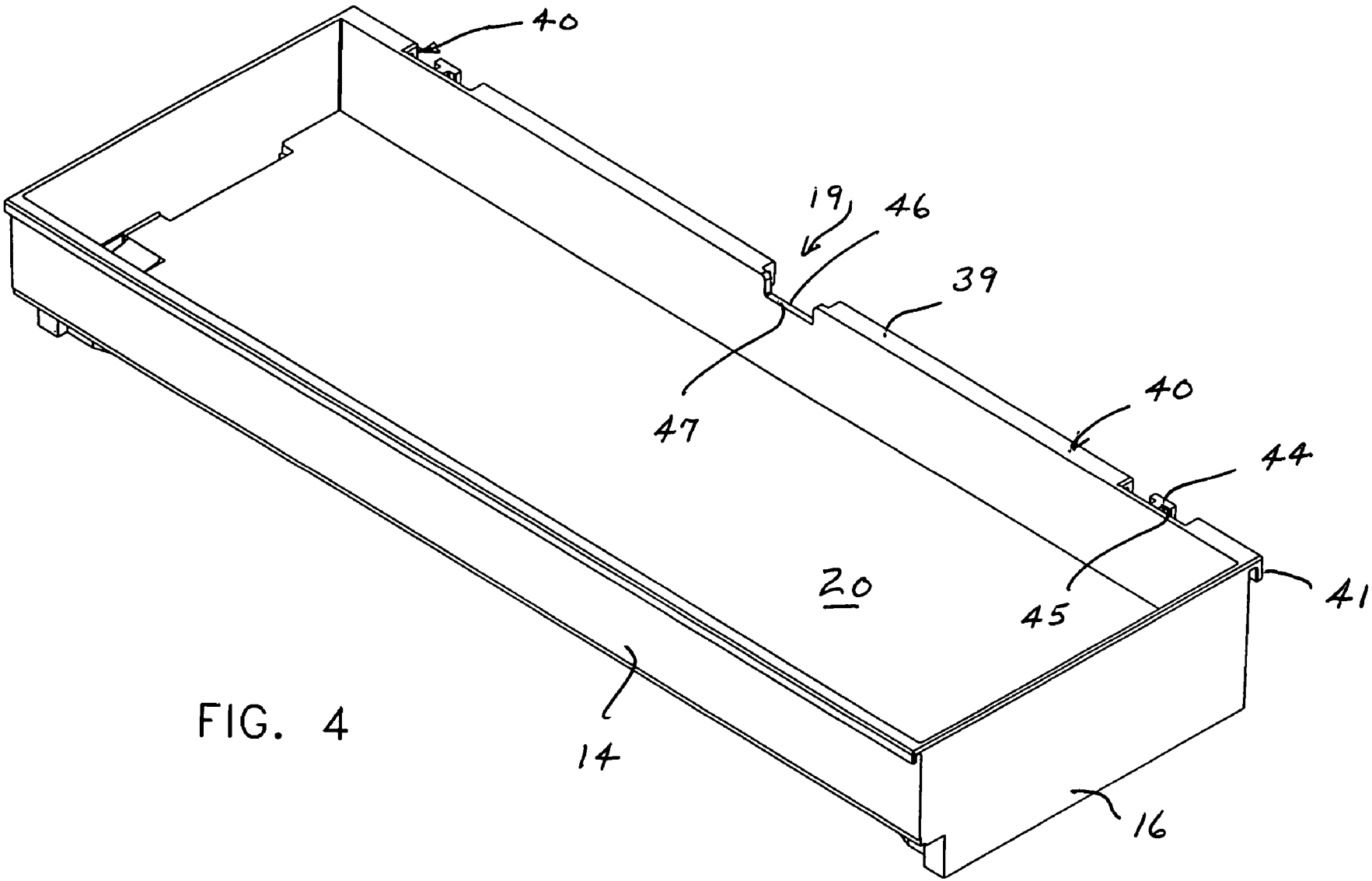
FIG. 4 is an enlarged view of the shelf shown in FIG. 1 with the connector strip removed therefrom.
Figure 5:
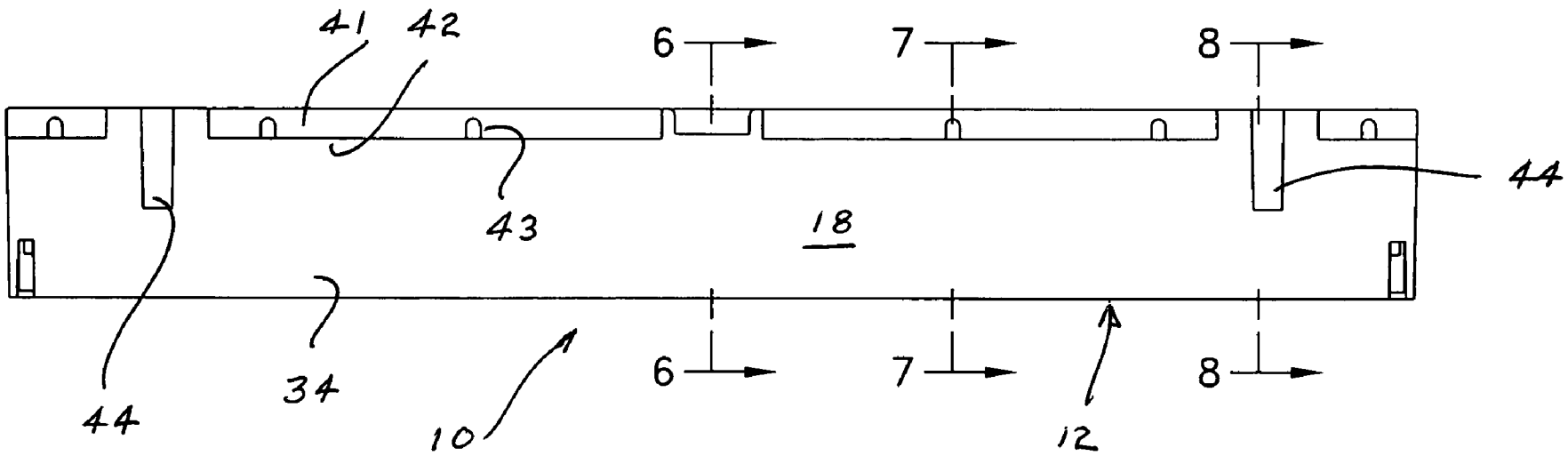
FIG. 5 is a rear elevational view of the shelf shown in FIG. 4.
Figure 6:
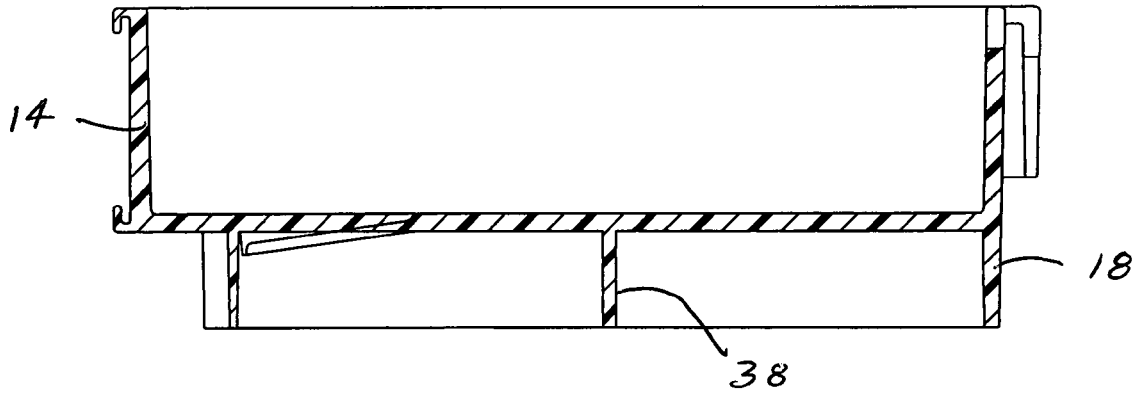
FIG. 6 is a sectional view taken along the line 6-6 of FIG. 5.
Figure 7:
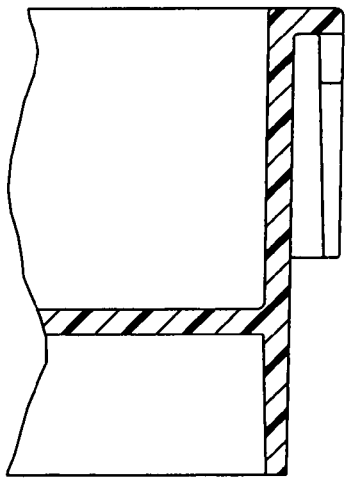
FIG. 7 is a partial sectional view taken along the line 7-7 of FIG. 5.
Figure 8:
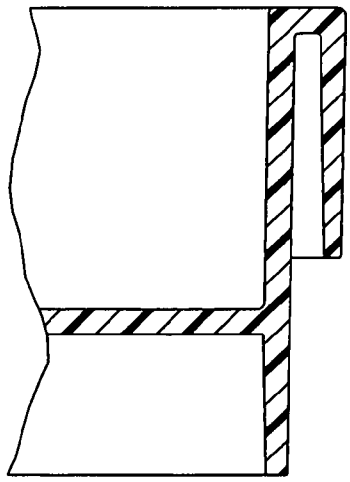
FIG. 8 is a partial sectional view taken along the line 8-8 of FIG. 5.
Figure 9:
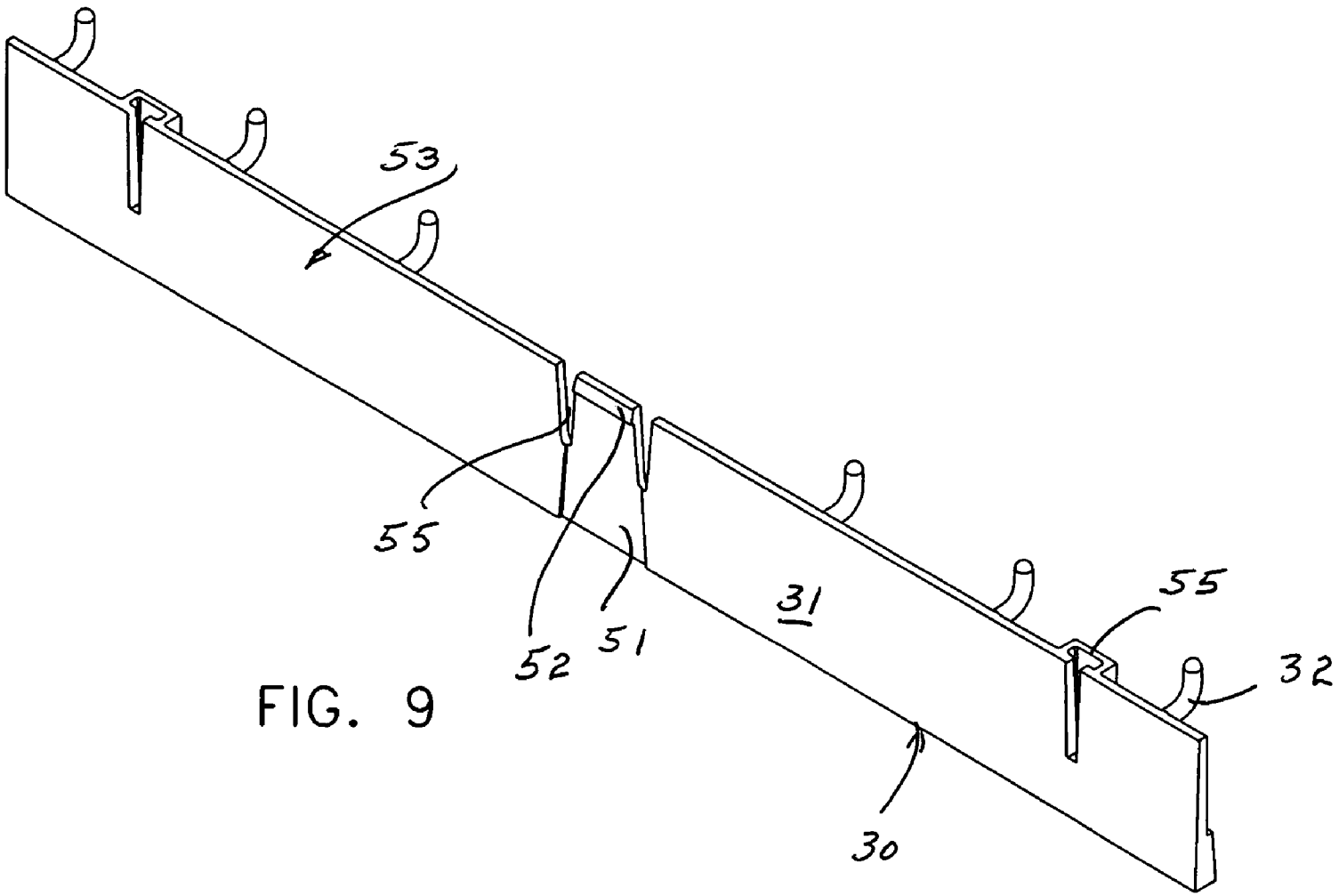
FIG. 9 is an enlarged view of the connector strip shown in FIG. 3.
Figure 10:
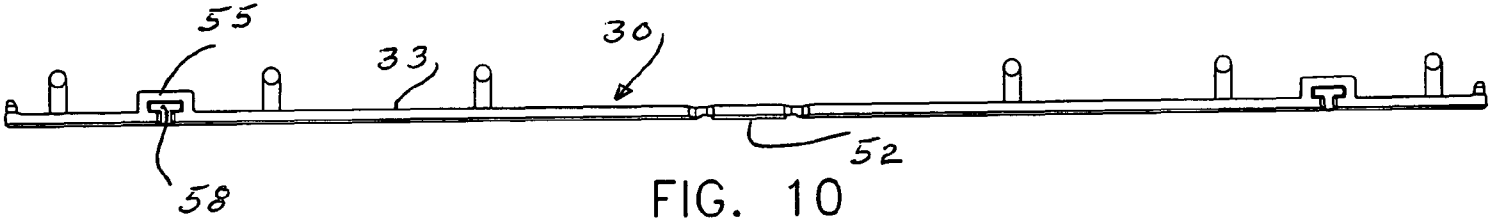
FIG. 10 is a top plan view of FIG. 9.
Figure 11:
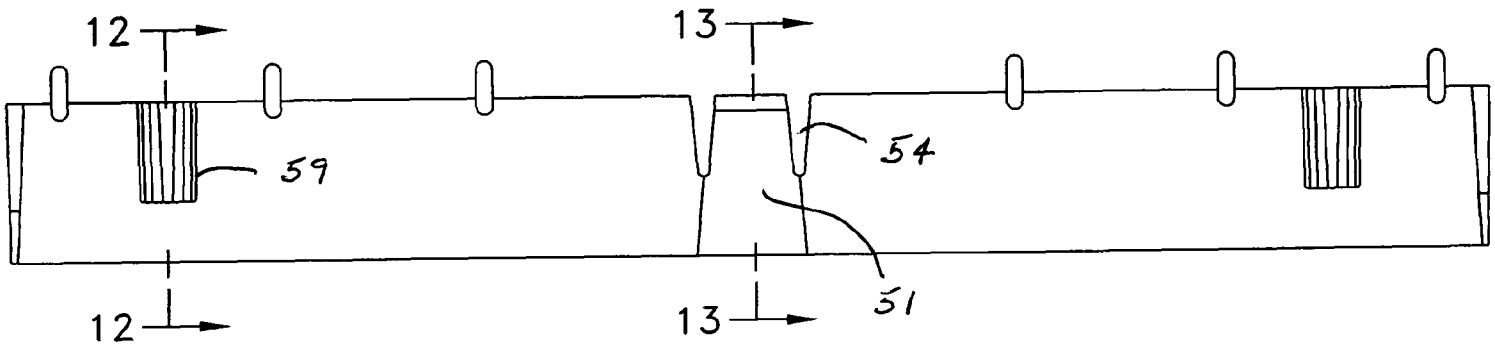
Figure 13:
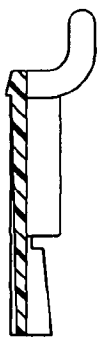
FIG. 13 is a sectional view taken along the line 13-13 of FIG. 11.
Figure 12:
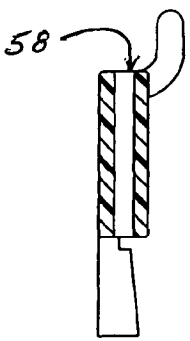
FIG. 12 is a sectional view taken along the line 12-12 of FIG. 11.

Referring to the drawings and particularly FIGS. 1 and 1A, the general background and the primary novel feature of the invention are shown. Therein a shelf 10 is shown attached to a supporting pegboard 22 that comprises part of an end cap supporting wall 24. The shelf 10 includes a box-like body 12 including a front wall 14, sidewalls 16, a rear wall 18 and a bottom wall 20 which cooperatively form the open at the top display space in and on which merchandise is positioned and stocked for sale. The rear wall 18, in turn, receives a removable connector strip 30 having hanging or supporting hooks 32 rearwardly upwardly extending therefrom and adapted for positioning into holes 26 of the supporting wall 24 to mount the shelf in a horizontal position vis-à-vis the vertical wall 24 with its open display space DP available for merchandise. The connector strip 30 has an inner face 31 and an outer face 33.

It should be pointed out that while the shelf 10 shown includes a removable connector strip attached to the rear wall 18 which is a feature of the present invention, current prior art devices that include hooks directly and integrally attached to the shelf rear wall can be illustrated via a discussion of FIG. 1A even though FIG. 1A incorporates the present invention. Therein if one wishes to remove the bottom shelf shown in FIG. 1A, it would be necessary to remove the top shelf first since there is insufficient headspace between the top of the bottom shelf and the bottom of the top shelf to enable the bottom shelf to be adequately upwardly tilted to enable the hanging hooks to assume a generally horizontal attitude and be slid out of the pegboard openings or holes 26. This, of course, might not only require removal of the overlying shelf but several or all the shelves above the one shelf desired to be repositioned as previously discussed.

This problem is avoided by providing a removable connector strip 30 that includes the hanging hooks or fingers 32 on the connector strip 30 itself rather than on the rear wall 18 of the shelf itself. Thus when a shelf is to be to repositioned, the shelf is removed from the connector strip 30 via a simple vertical movement, then the connector strip 30 is upwardly tilted and removed from the holes 26 and then reinserted into holes 26 above or below the original position, then the shelf slid into the headspace and downwardly moved such that the rear wall is reconnected to the connector strip. This procedure avoids the aforementioned drawbacks of the prior art above indicated and will be more clearly explained with specific reference to further drawings of the invention particularly in the sequence of FIGS. 14-19.

Again, it should be pointed out that even though present prior art shelves have integral hooks which form a part of the shelf rear wall and the shelves in FIG. 1A do not and actually include the improved present invention, the problems caused by such devices can be demonstrated by illustratively leaving the connector strip attached to the rear wall. Thus, the FIG. 1A illustration can be used to represent the problems of the prior art that are overcome by the present invention.

In further describing the shelf construction of the present invention, attention is directed to FIGS. 4-8. Therein, the shelf rear wall 18 construction adapted to receive the connector strip 30 is shown in detail. The shelf front wall 14 may be of a lesser vertical extent than that of the rear wall 18 to reduce the front profile. Reinforcing struts 38 may be included to stiffen the shelf. The rear wall 18 includes a generally flat planar surface or outer face 34 that is adapted to receive the inner face 31 of the connector strip 30. In addition, the rear wall 18 terminates at the upper end thereof in a flat top wall 39 which rearwardly and downwardly extends via a lip 41 to form a generally U-shaped channel 40 that is adapted to receive the upper edge 50 of the connector strip 30 as will hereinafter be apparent. The top wall lip 41 terminates in a terminal edge 42 that is provided with upwardly extending slots 43 that are laterally disposed along the length of the strip and which are adapted to receive the base of the hooks 32 outwardly rearwardly extending from the outer face 34 thereof. Also, at least a pair of vertically oriented guideposts 44 are laterally spaced from each other and outwardly, that is, rearwardly extend from the outer face 34, and may be of graduated width from top to bottom. The guideposts 44 include a narrow connecting web 45. The guideposts 44 are, in turn, adapted to be aligned with and received in the guide channels 55 provided on the connector strip 30. Thus, it should be clear that the connector strip 30 can be slid upwardly vis-à-vis the rear wall of the shelf or vice versa to position the strip upon the rear wall. The guideposts 44 and the guide channels 55 thus form a positioning and connecting system for mounting the connector strip 30 to the rear wall 18.

In order to maintain the above described connected fully assembled configuration, the rear wall 18 includes locking means 19. Such to locking means 19 include a generally rectangular notch 46 extending downwardly from a central location along the top wall 39 which notch 46 terminates in a locking edge 47, in turn, adapted to receive the inwardly directed locking lug 52 of a locking arm 51 that vertically extends from the body 53 of the connector strip 30 and is defined by generally V-shape notch openings 55 on either side thereof. It should be noted that the shelf 10 is preferably formed of a somewhat flexible or slightly flexible plastic resin, e.g., polycarbonate, and in this way as the shelf and strip are assembled together, the locking arm 51 is slightly rearwardly flexed and then when the upper edge 50 of the strip 30 is fully engaged with the channel 40 then the locking arm is adapted to resiliently snap forward to position the locking lug 52 over the locking edge 47 and thus maintain and secure the connector strip 30 in operational engagement with the rear wall 18 and thus the shelf 10 itself. When it is desired to remove the connector strip 30 from the shelf 10 or in actual operation of the system, to remove the shelf from the strip, it is only necessary to rearwardly push in the locking lug 52 and then lift the shelf vertically until the shelf fully disengages from the strip.

Figure 14:
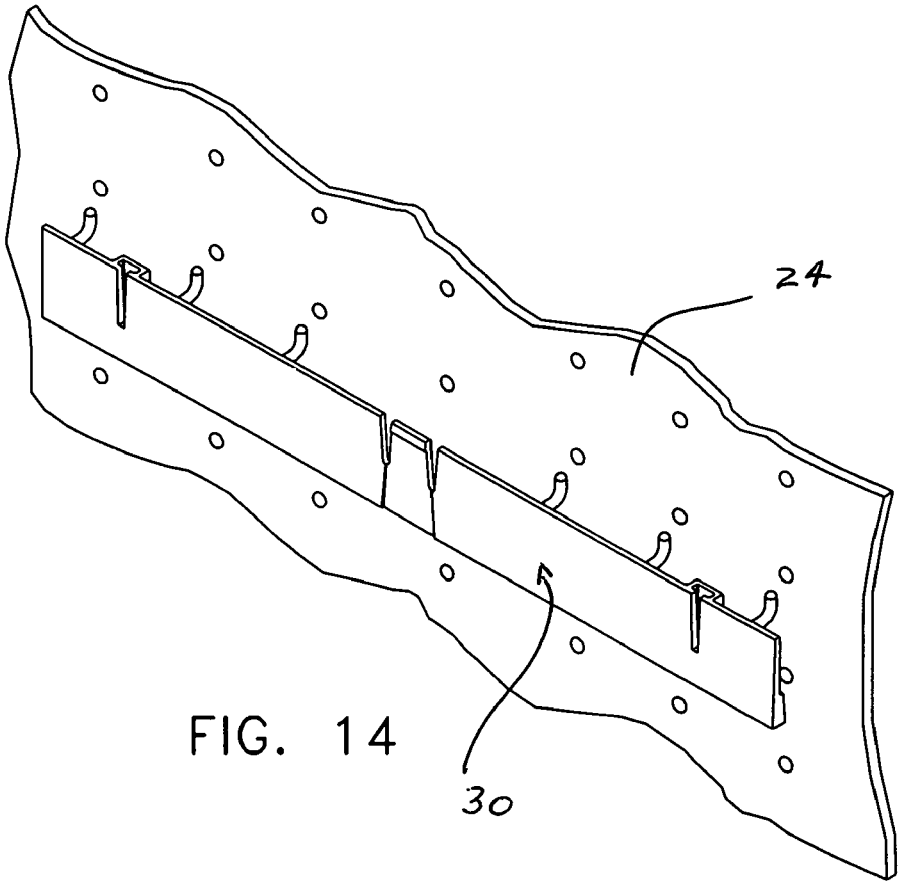
FIG. 14 is a front perspective view of the connector strip shown in FIG. 3 positioned in front of an end cap pegboard for connection thereto.
Figure 15:
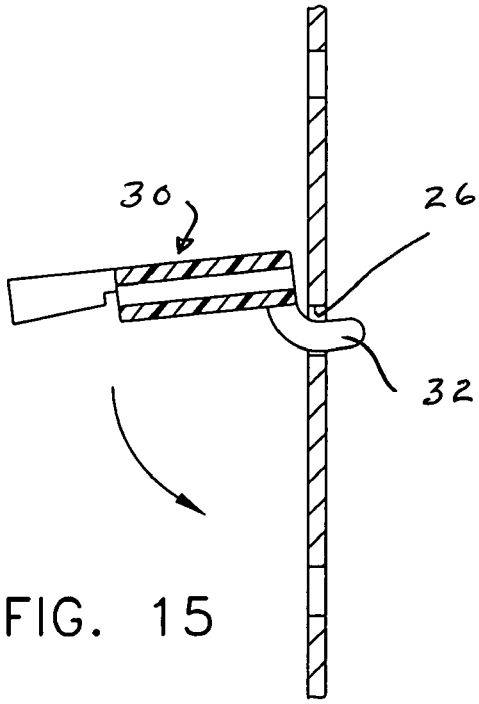
FIG. 15 is a side sectional view of FIG. 14 showing the manner in which the pegs of the connector strip are inserted into the pegboard openings.
Figure 16:
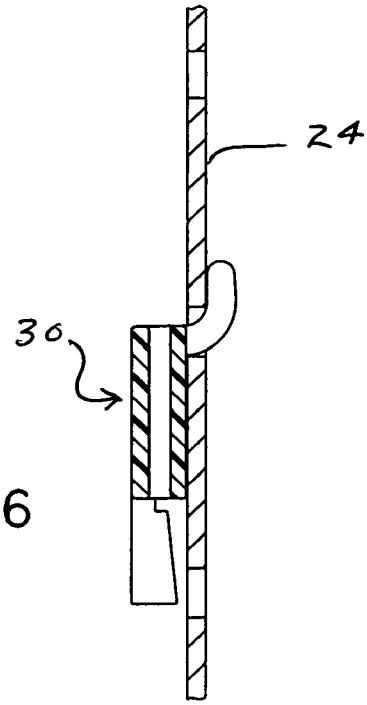
FIG. 16 is a side sectional view similar to FIG. 15 but showing the connector strip fully inserted into the pegboard openings and rotated to a mounted position thereon.
Figure 17:
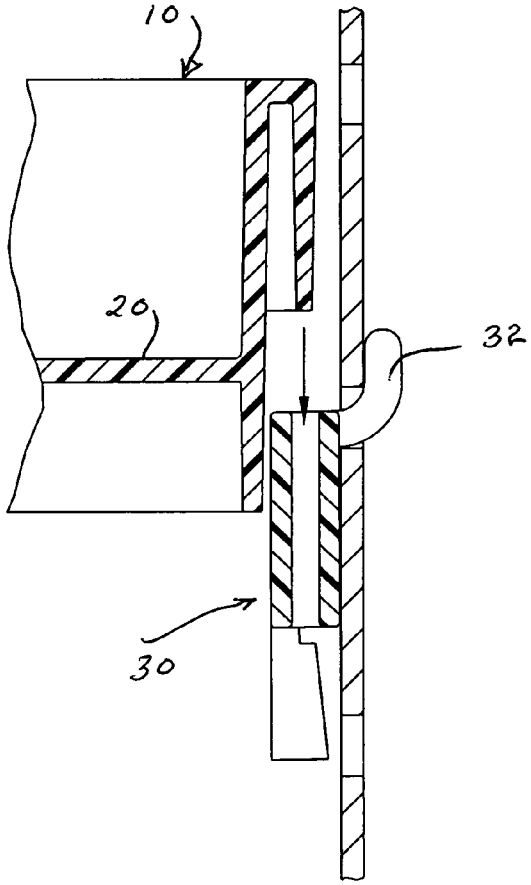
FIG. 17 is a sectional view showing the manner in which the shelf may be connected to the connector strip while the strip is, in turn, mounted to the pegboard.
Figure 18:
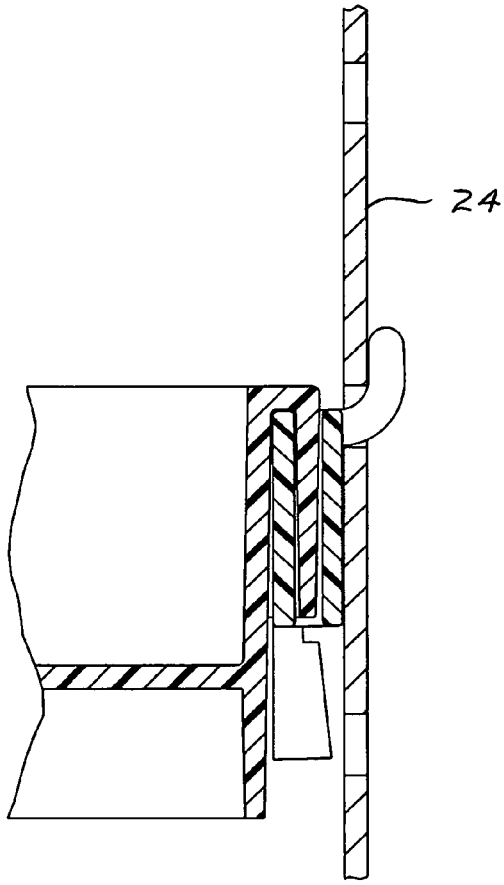
FIG. 18 is a sectional view similar to FIG. 17 but showing the shelf fully connected to the connector strip.
Figure 19:
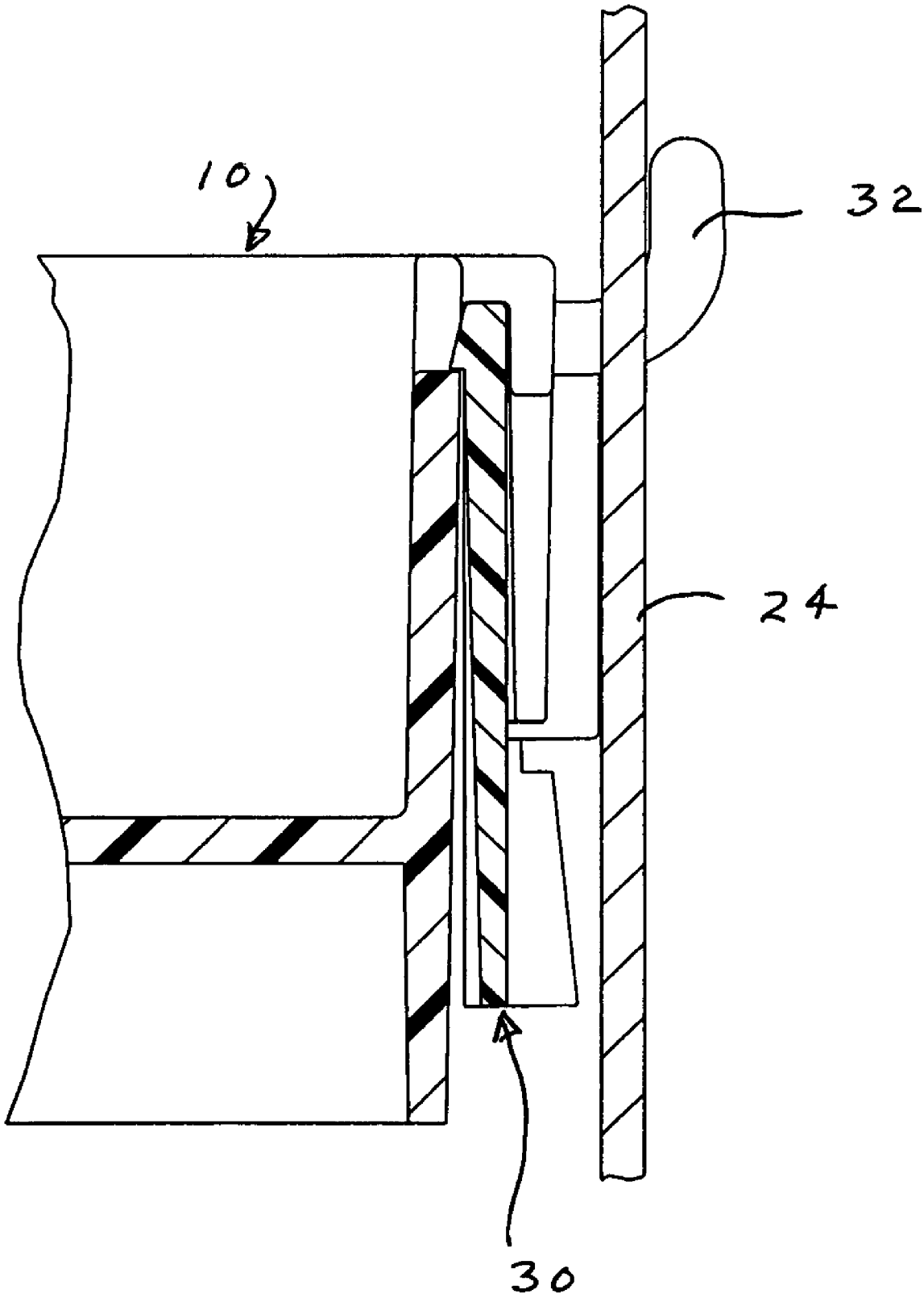
FIG. 19 is a sectional view similar to FIG. 18 but taken centrally of the shelf and connector strip assembly and shows the manner in which the locking plate engages the locking edge portion of the shelf top edge.

This aforementioned action would be utilized when the strip is connected to the end cap wall via the hooks 36 being engaged therewith via insertion through the openings 26. After the shelf is removed from the connector strip 30, the strip 30 can, in turn, be removed from the end cap wall by lifting such upwardly, that is, tilting the strip upwardly, to release the hooks 36 and then reinsert the hooks into a different set of openings 26 thereby adjusting the vertical position of the strip vis-à-vis the end cap wall. This procedure is illustrated in FIGS. 14-16. Thereafter, the shelf can be positioned over the connector strip 30 that is attached to the end cap wall and then pushed downwardly as previously explained to reengage and lock the shelf rear wall 18 with the connector strip 30. The vertical spacing between the shelf to be vertically repositioned and the shelf thereabove is minimal, that is, only a slightly greater vertical extent than the overall shelf height, which is a fax lesser dimension than would be necessary if the entire shelf was to upwardly tilted as in the prior art to position the hooks to a release position.

Further constructional features of the connector strip 30 will be apparent when considered in conjunction with FIGS. 9-13. The outer face 33 of the body thereof includes a pair of hollow guide channels 55 as previously indicated. The guide channels 55 are vertically oriented and laterally spaced to align with the positioning guideposts or bars 44. Each guide channel 55 includes an open top 58 adapted to receive the bottom of the respective guideposts 44 when the shelf rear wall 18 is aligned vertically above the connector strip 30. The body 59 of each channel 55 forms a hollow interior guide passage that receives the guidepost(s) 44. The upper end, that is, the top 58 of the channel 55, may be wider than the bottom thereof to form a lead-in for the guidepost 44 and to gradually assure that the guidepost(s) 44 are laterally aligned as the shelf rear wall 18 and connector strip 30 are fully engaged with each other and to further assure alignment of the slots 43 with the hooks 36 and the locking arm 51 with the notch 46. The bottom of the channel may be open or closed; however, an open channel bottom configuration facilitates the molding process.

Figure 20:
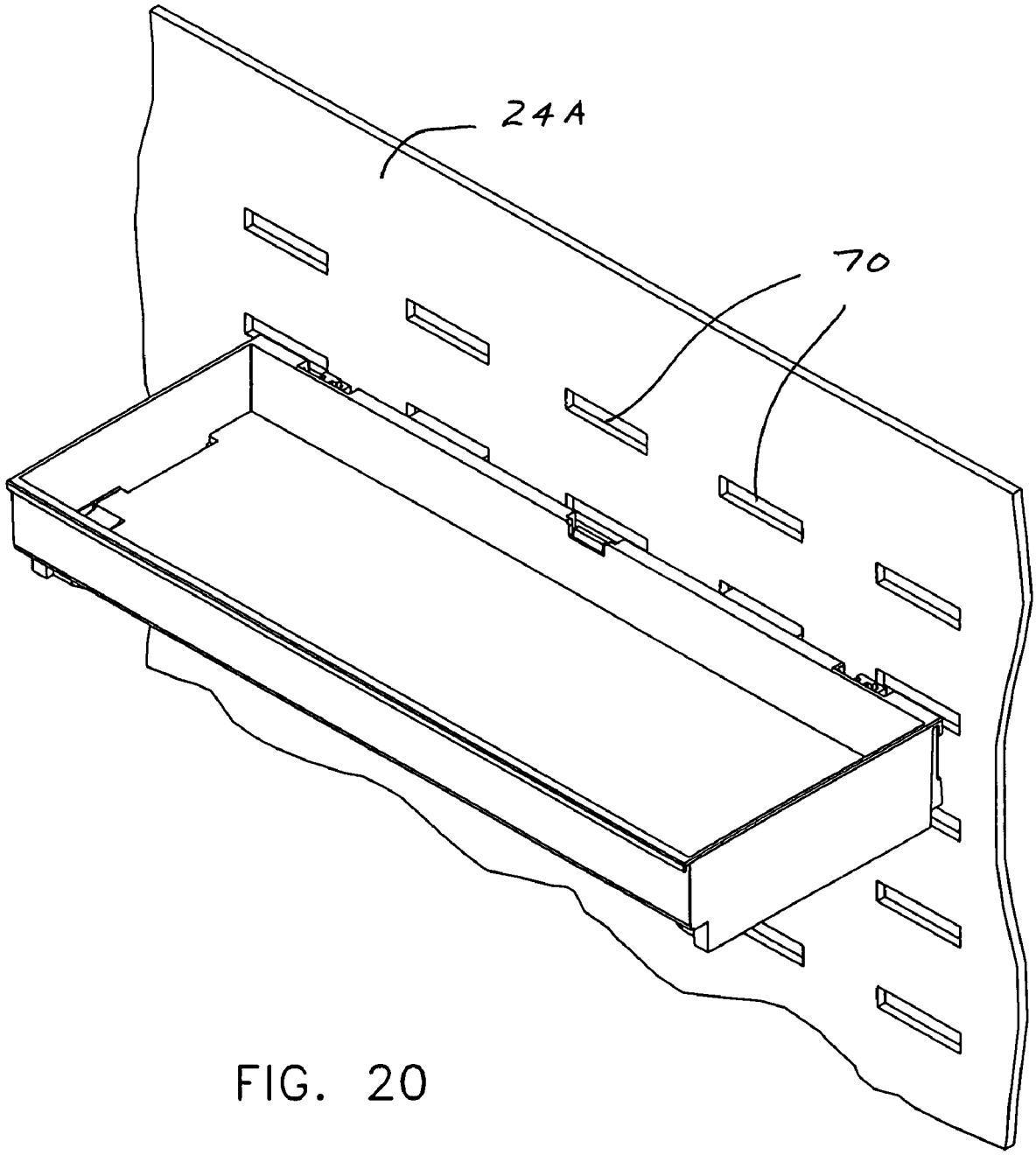
FIG. 20 is a front perspective view similar to FIG. 1 but illustrating a modified form of the connector strip to accommodate a slotted board-receiving opening in the end cap wall.
Figure 21:
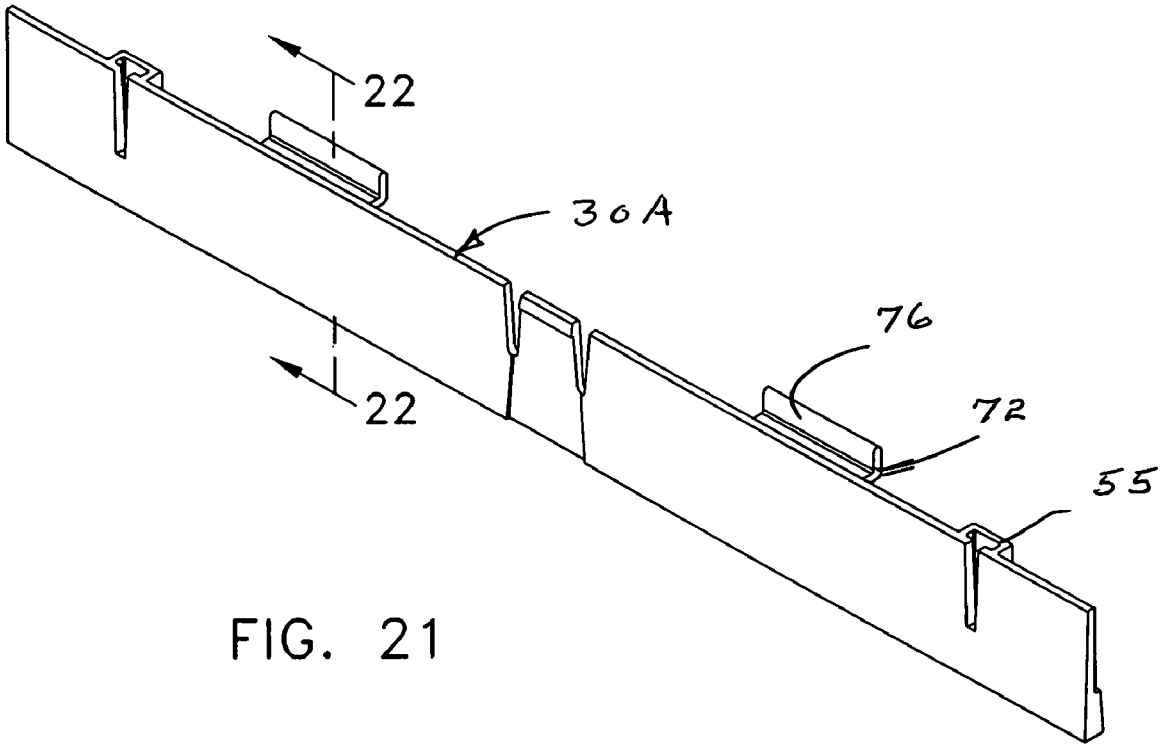
FIG. 21 is a perspective view of the modified form of the connector strip of FIG. 20.
Figure 22:
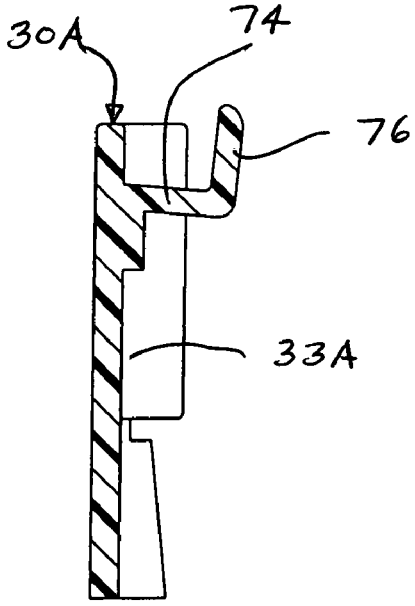
FIG. 22 is a sectional view along the line 22-22 of FIG. 21.

A further modification of the invention is shown in FIGS. 20-22 wherein the form of the mounting means by which the shelf 10 and the connector strip 30 connected thereto are mounted to the end cap 22. In that regard, some end cap walls 24A include horizontally and vertically disposed slots 70 rather than circular openings or holes 26. Accordingly in such configurations, the connector strip 30A can be provided with end cap connection means of a modified form such as the bars 72 outwardly rearwardly extending from the outer face 33A of the strip 30A. Each bar 72 includes a first panel 74 outwardly extending from the strip 30A and terminating in an upwardly directed second panel 76 that is adapted for insertion into the slots 70 in the same manner as indicated with the previous embodiment. No other modifications or changes are necessary in the formation of the modified strip 30A. Other than the absence of the hooks 36, the connector strips 30 and 30A are constructionally and functionally identical. The shelf 20 rear wall 18 construction accepts either the 30 or 30A strip without modification.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An end cap shelf system for mounting display shelves upon an end cap wall having openings adapted to receive shelf supporting means comprising a shelf having a flat bottom wall, a rear wall and front and side walls defining an open top display space adapted to receive merchandise for sale, said rear wall being laterally disposed and having a generally flat outer surface, a separate thin walled connector strip having generally planar opposed inner and outer faces and connecting means cooperatively provided on the outer face of said shelf rear wall and the inner face of said connector strip for releasably engaging said connector strip to said shelf rear wall when said connecting means are vertically and laterally disposed with each other, and releasable locking means for holding said connector strip and said rear shelf wall in assembled engaged position, said strip outer face including the shelf supporting means, said releasable locking means including an upwardly extending deflectable arm positioned on said connector strip and an upper edge section of said rear wall laterally aligned therewith in said assembled engaged position, said arm having an inwardly extending lug adapted to rest upon said upper edge section.

2. The system set forth in claim 1, said connector strip of a vertical height less than that of said shelf rear wall, said shelf rear wall top edge defined by a downwardly extending notch.

3. An end cap shelf system for mounting display shelves upon an end cap wall having openings adapted to receive shelf supporting means comprising a shelf having a flat bottom wall, a rear wall and front and side walls defining an open top display space adapted to receive merchandise for sale, said rear wall being laterally disposed and having a generally flat outer surface, a separate thin walled connector strip having generally planar opposed inner and outer faces and connecting means cooperatively provided on the outer face of said shelf rear wall and the inner face of said connector strip for releasably engaging said connector strip to said shelf rear wall when said connecting means are vertically and laterally disposed with each other, and releasable locking means for holding said connector strip and said rear shelf wall in assembled engaged position, said strip outer face including the shelf supporting means, said shelf supporting means outwardly extending from said outer connector strip face for connecting said strip to the end cap wall and thus, in turn, the shelf when said strip is in the assembled engaged position with said shelf, said shelf supporting means being a plurality of curved hooks outwardly upwardly extending from the rear face of said connector strip, said rear wall terminating at the upper end thereof in a downwardly directed U-shaped channel, in turn, adapted to receive the upper edge of said connector strip, said channel including a downwardly extending terminal edge wall, in turn, having upwardly extending laterally spaced slots adapted to receive said curved hooks.

4. An end cap shelf system for mounting display shelves upon an end cap wall having openings adapted to receive shelf supporting means comprising a shelf having a flat bottom wall, a rear wall and front and side walls defining an open top display space adapted to receive merchandise for sale, said rear wall being laterally disposed and having a generally flat outer surface, a separate thin walled connector strip having generally planar opposed inner and outer faces and connecting means cooperatively provided on the outer face of said shelf rear wall and the inner face of said connector strip for releasably engaging said connector strip to said shelf rear wall when said connecting means are vertically and laterally disposed with each other, and releasable locking means for holding said connector strip and said rear shelf wall in assembled engaged position, said strip outer face including the shelf supporting means, said connecting means comprising at least a pair of laterally spaced vertically disposed guide members disposed on the outer face of said rear wall and adapted to receive a pair of vertically disposed positioning members laterally displaced on the inner face of said connector strip, said connecting means positioning members being at least a pair of laterally spaced vertically disposed channel members outwardly extending from the outer face of said connector strip, said rear wall guide members being posts adapted to extend downwardly into said channels.

5. The system set forth in claim 4, said channel members being open ended at the bottom and top thereof and wherein said open-ended tops are of a wider lateral extent than the bottoms thereof so as to provide a positioning lead in for said posts.

6. An end cap shelf system for mounting merchandise display shelves upon an end cap wall having openings adapted to receive shelf supporting means, comprising a shelf having a flat bottom wall, a rear wall and front and side walls to define an open top display space available to receive merchandise for sale, said rear wall being laterally disposed and having a generally flat outer surface including at least a pair of laterally spaced vertically disposed guide post members for receiving a separate thin wall connector strip of a vertical height less than that of said shelf rear wall and having generally planar opposed inner and outer faces, said connector strip further including a pair of vertically disposed positioning channel members laterally aligned with said guide members and adapted for engaging connection therewith when said guide post members and said positioning channel members are superimposed with each other, and releasable locking means for maintaining the assembled engaged position of the connector strip to the shelf rear wall, said connector strip having end cap wall connection connecting means outwardly extending from said outer face thereof for connecting said strip and thus the shelf, in turn, connected to said strip to the end cap wall.

7. The method of repositioning an intermediate shelf of one of a series of shelves vertically spaced from each other and mounted on an end cap wall wherein said shelves each have a flat bottom wall, a rear wall and front and side walls defining an open top display space adapted to receive merchandise for sale, said rear wall being laterally disposed and having a generally flat outer surface, a separate thin walled connector strip having generally planar opposed inner and outer faces and connecting means cooperatively provided on the outer face of said shelf rear wall and the inner face of said connector strip for releasably engaging said connector strip to said shelf rear wall when said connecting means are vertically and laterally disposed with each other, and releasable locking means for holding said connector strip and said rear shelf wall in assembled engaged position, said strip outer face including said shelf supporting means, comprising releasing the means for holding the connector strip, thereafter vertically moving the shelf upwardly to fully disengage the shelf from the connector strip and then forwardly moving the shelf out of line with the shelf immediately above, then upwardly tilting the connector strip to release the shelf supporting means from the end cap wall and then repositioning the connector strip in different end cap wall openings and then repositioning the shelf over the repositioned connector strip and finally assembling the shelf to the repositioned connector strip via a downward movement of the shelf with respect to said connector strip.

* * * * *